United States Patent [19]

Fairchild, Jr.

[11] 4,139,132

[45] Feb. 13, 1979

[54] BACKPACK LEVERS

[75] Inventor: William A. Fairchild, Jr., Boulder, Colo.

[73] Assignee: Martha S. Fairchild, trustee, Boulder, Colo.

[21] Appl. No.: 783,320

[22] Filed: Mar. 31, 1977

[51] Int. Cl.[2] ..... A45F 3/00

[52] U.S. Cl. ..... 224/25 A; 224/8 R

[58] Field of Search ..... 224/25 R, 25 A, 5 P, 224/5 BC, 5 Z, 5 N, 5 S, 8 R, 6

[56] References Cited

U.S. PATENT DOCUMENTS

| | | | |
|---|---|---|---|
| 978,821 | 12/1910 | Brown et al. | 224/5 P |
| 1,150,664 | 8/1915 | Cramer | 224/25 A |
| 2,208,962 | 7/1940 | Finetti | 224/25 A |
| 3,885,722 | 5/1975 | Robertson | 224/5 BC |

FOREIGN PATENT DOCUMENTS

| | | | |
|---|---|---|---|
| 380036 | 4/1940 | Italy | 224/25 A |

*Primary Examiner*—Galen L. Barefoot
*Assistant Examiner*—Sherman D. Basinger
*Attorney, Agent, or Firm*—James R. Young

[57] ABSTRACT

A pair of levers are pivotally attached to the rigid frame of a backpack apparatus and extend forwardly over the shoulders of a person wearing the backpack and downwardly so that its distal or lower free end is positioned a spaced distance in front of the person's waist at a location conveniently within reach of his arms. A rotatable shoulder pad is provided on each lever near the point of pivotal attachment to the backpack frame to distribute the weight of the backpack over a larger area of the person's shoulders and to reduce the sharpness of the levers bearing on the person's shoulders. Each pad has a curved upper surface and is attached to the lever by a resilient strap such that the pad can rotate or rock to a limited extent independently of the lever. When the backpack is placed with the levers and shoulder pads in proper position on the person's shoulders, he can transfer the weight of the backpack to bear substantially vertically downward on his shoulders by applying a relatively small downwardly directed force on the distal end of the lever with his arms. A flexible strap is also attached to and extends between the distal end of each lever and the lower end of the rigid backpack frame to limit the outward and upward rotation of the lever about its point of pivotal attachment to the backpack frame to relieve the person from having to constantly hold the levers down with his arms and also to maintain the levers in a position to function as a stand to maintain the backpack in substantially upright position when not being worn.

10 Claims, 9 Drawing Figures

BACKPACK LEVERS

BACKGROUND OF THE INVENTION

The present invention relates generally to apparatus for carrying cargo and more particularly to backpacks adaptable for use on extended hiking or camping expeditions.

Backpacks of various designs and configurations are commonly used by hikers, campers and others to carry cargo on their backs or shoulders for extended distances. Because the center of gravity of the loaded backpack is a spaced distance behind the wearer's body, the force of gravity acting through the center of gravity of the cargo in combination with the upwardly directed supporting force exerted by the wearer's shoulders creates a force couple tending to rotate the wearer's shoulders backward and downward. In order to maintain an upright posture, this couple must be resisted primarily by the wearer's lower back. The application of these forces to the wearer's lower back over extended periods of time often results in fatigue and possible injury to the back. The stress of the shoulder strap on the collarbone from a conventional backpack which compresses the upper trunk of the brachial plexus against the underlying rib cage is also believed to be a primary cause of pack pulsy which has a high rate of occurrence among backpackers.

Several attempts have been made to alleviate these problems caused by common backpacks. The U.S. Pat. No. 2,208,962 issued to G. DeFinetti and the Italian Pat. No. 380,036 issued to P. Spalla, both disclose rigid levers extending forwardly over the wearer's shoulders from a rigid backpack frame and have widened or padded shoulder pads. While these innovations are partially effective to relieve some of the problems caused by conventional backpacks, they also have certain disadvantages. The apparatus of the present invention is designed to more effectively shift the load to the person's shoulders and arms and away from his upper chest and lower back, as well as to provide more convenience, flexibility, safety, and ease of use.

SUMMARY OF THE INVENTION

Accordingly, it is an object of the present invention to provide a new and novel backpack apparatus for applying the forces from the weight of the backpack on the wearer's shoulders and arms instead of on his upper chest and lower back.

It is another object of the present invention to provide a backpack apparatus which is convenient for the person to put on and take off quickly, yet comfortable to wear.

A further object of the present invention is to provide a backpack apparatus with levers to transfer the weight of the backpack to the wearer's shoulders and arms including pivotal shoulder pads capable of conforming to the contour of a particular person's shoulders at the position in which it is being worn. A still further object of the present invention is to provide a backpack with levers for transferring the weight of the backpack to the wearer's shoulders and arms and which serve the dual purpose of providing a stand or support to retain the backpack in upright position when it is not being worn.

The present invention is directed to a novel apparatus for transferring the weight of a backpack to a person's shoulders and arms, including two spaced-apart levers, each of which is pivotally attached at one end to a rigid backpack frame and extending forwardly over the wearer's shoulders and downwardly to a position a spaced distance in front of his waist convenient for grasping by a person's hand. Shoulder pads are adjustably secured to the underside of each lever near the point of pivotal attachment to the backpack frame for distributing the weight and providing cushioning over the person's shoulders. The pads are curved to have a convex rounded top surface which is retained in pivotal contact with the underside of the lever by a resilient strap attached to the shoulder pad and extending over the top of the lever. When the backpack is placed on a person's back with the levers and shoulder pads in proper position on his shoulders, he can reduce the transverse force applied by the backpack on the lower portion of his back by pulling the distal ends of the levers downwardly with his arms. This application of force on the distal end of the levers has the effect of transferring the effective location of downwardly directed force components forward to the person's shoulders, thus relieving the transverse stress on the wearer's lower back.

The backpack apparatus is also provided with a flexible strap on each lever extending between its distal end and the lower portion of the backpack frame to maintain the levers in the proper forwardly and downwardly extended position when the wearer wishes to rest his arms or to use his arms for other purposes. This flexible strap is adjustable in length so that the the lever can be set to act as a stand or support to maintain the backpack in substantially upright position when it is not being worn.

BRIEF DESCRIPTION OF THE DRAWINGS

Other objects, advantages and capabilities of the present invention will become more apparent as the description proceeds, taken in conjunction with the accompanying drawings, in which.

DETAILED DESCRIPTION OF THE PREFERRED EMBODIMENT

Figure 1:
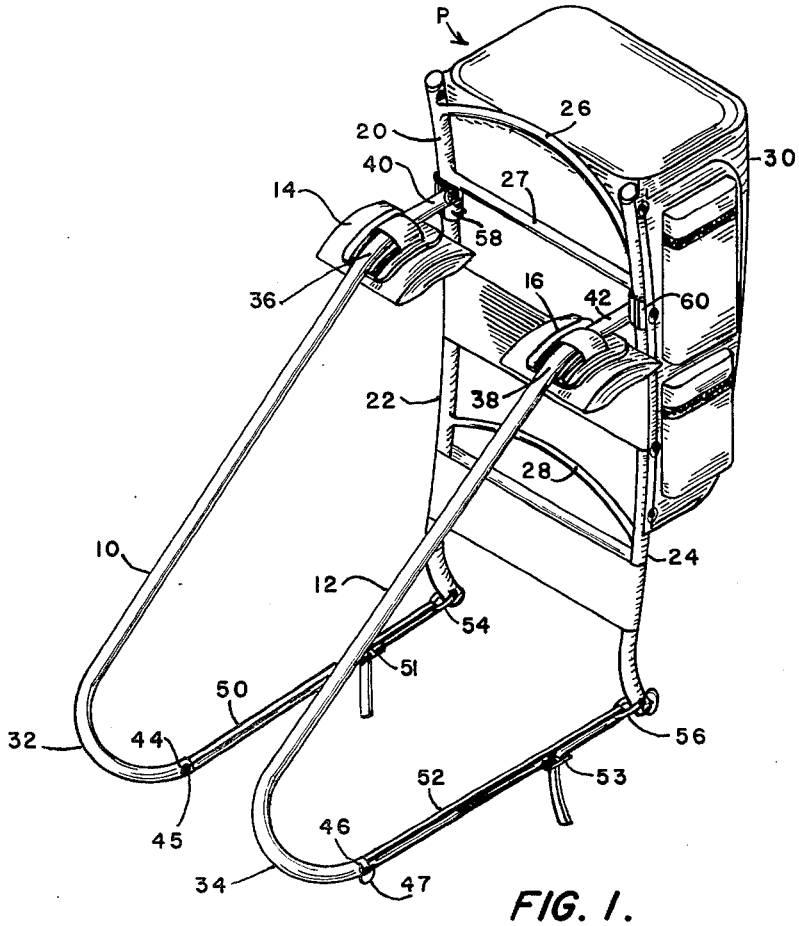
FIG. 1 is a perspective view of the backpack apparatus with the levers retained in proper relation to the rigid frame to support the backpack in upright position when not being worn.

The backpack levers 10, 12 of the present invention are shown in FIG. 1 in combination with a conventional backpack P having a rigid frame 20 and cargo or luggage compartment 30. The rigid frame 20, which forms no part of this invention but which is described for purposes of clarity in understanding the present invention, includes two substantially vertical, spaced-apart rigid members 22, 24 and several cross members 26, 27 and 28 to provide a rigid structural support for the luggage component or compartment 30.

Figure 2:
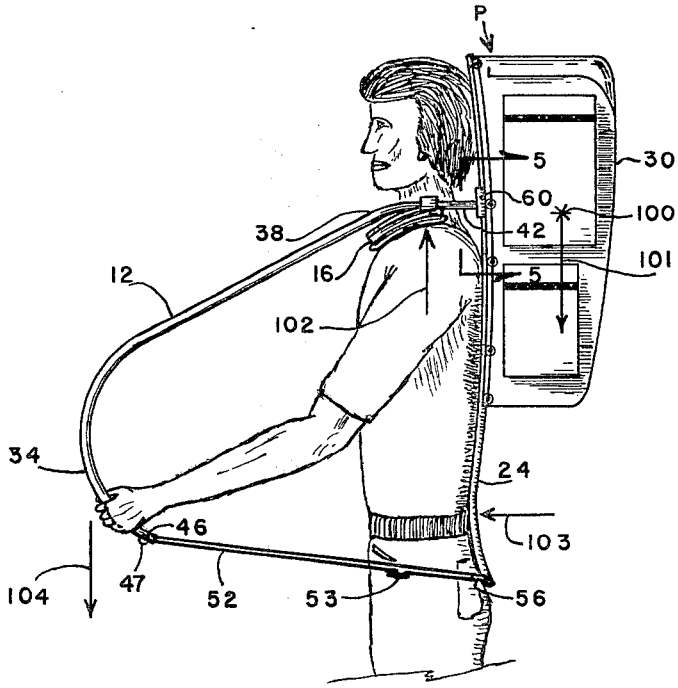
FIG. 2 is a side elevation view of the backpack being worn by a person.

The levers 10, 12 of the present invention are pivotally attached in substantially parallel, spaced-apart relation to each other to the frame 20. Lever 10 is attached to the upper portion of vertical member 22 by pivotal connector 58, and lever 12 is attached to the upper portion of vertical member 24 by pivotal connector 60. The upper end 40, 42 of each lever 10, 12, respectively extends forwardly from the respective upright frame member 22, 24 a short distance to a position over the wearer's shoulder as seen in FIG. 2. It is then curved at 36, 38 to extend forwardly and downwardly a substantial distance in front of the wearer's chest and torso and then terminate in a wide curve 32, 34 at its distal end a distance in front of the wearer's body for convenient grasping with his hand.

Figure 3:
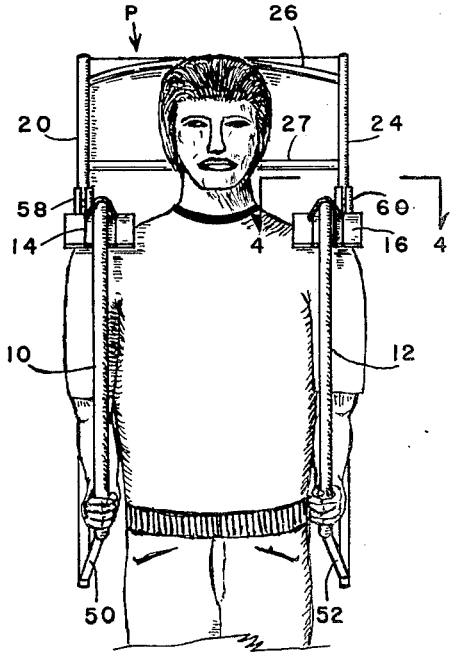
FIG. 3 is a front elevation of the backpack being worn by a person.

FIGS. 2 and 3 illustrate the backpack P and levers 10, 12 with shoulder pads 14, 16 of the present invention positioned properly on a wearer's shoulders. A shoulder pad 14, 16 is adjustably secured on each lever 10, 12, respectively, in the vicinity of the first curve 36, 38 for distributing the weight of the backpack over a wider area on the user's shoulder and cushioning his shoulder from the discomfort that would otherwise be associated with concentration of a significant force by the relatively narrow levers, 10, 12.

Figure 4:
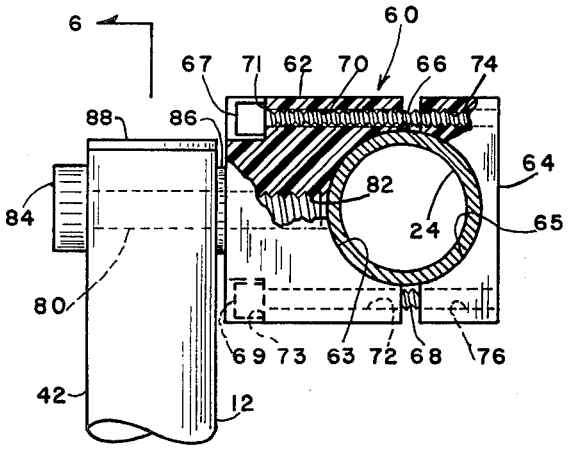
FIG. 4 is a sectional view of the pivotal connection means taken along lines 4—4 of FIG. 3, a portion of the clamp being cut away to reveal the interrelationship between the clamp sections and the clamping set screws.
Figure 5:
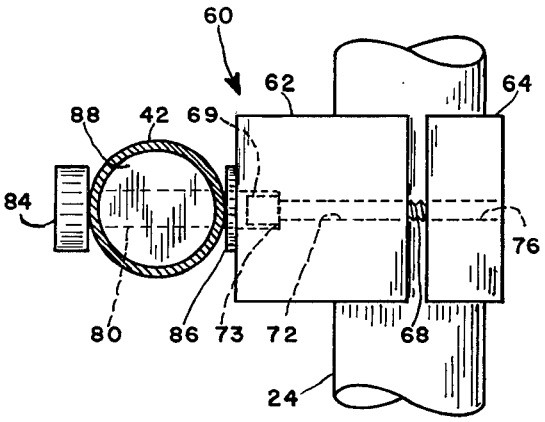
FIG. 5 is a sectional view of the pivotal attachment means taken along lines 5—5 of FIG. 2.

FIGS. 4 and 5 illustrate the details of pivotal connector 60 which is also typical for pivotal connector 58. The connector 60 is shown in elevation in FIG. 4, with the upright frame member 24 shown in section. The upper end 42 of lever 12 is shown pivotally connected to frame member 24 by connector 60. Essentially, the connector 60 includes a clamp comprised of two block sections 62, 64 attached together by set screws 66, 68. Each block section 62, 64 includes a curved inside surface 63, 65, respectively, facing each other to interface with the circumferential surface of upright frame member 24. The set screws 66, 68 are inserted into bores 70, 72, respectively in primary block section 62 and are threaded into bores 74, 76, respectively, in secondary block section 64. Therefore, the block sections 62, 64 of the clamp 60 can be securely clamped onto the upright frame member 24 by tightening set screws 66, 68. The heads 67, 69 of set screws 66, 68, respectively, are recessed into the primary block section 62 in holes 71, 73 so they do not interfere with movement of lever 12 and do not protrude to snag clothing.

Figure 6:
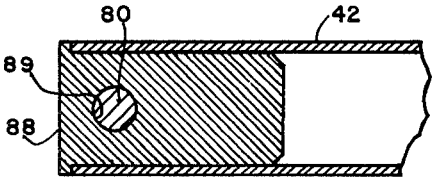
FIG. 6 is a cross-section view of the end of the lever taken along lines 6—6 of FIG. 4.

The end 42 of the lever 12 is attached to the primary block section 62 of connector 60 by pivot pin 80 inserted transversely through the end 42 of lever 12 and threadedly screwed into bore 82 in primary block section 62. The end 42 of lever 12 is prevented from sliding off the pivot pin 80 by head 84, and a washer 86 is provided at the interface of the end 42 of lever 12 and the primary block section 62 of clamp 60 to eliminate rubbing contact or binding therebetween. Also, since a significant amount of force must be transferred to the end 42 of lever 12 by the pivot pin 80, a reinforcing block 88 is inserted into the end 42 of lever 12 to provide an increased bearing surface between pivot pin 80 and end 42 of lever 12 throughout the entire bore 89, as shown in FIG. 6.

The advantages of backpack levers 10, 12 of the present invention in carrying loaded backpacks for considerable periods of time without transverse strain on the lower portion of the wearer's back can be best illustrated by reference to FIG. 2 wherein the normal center of gravity 100 for a loaded backpack is indicated at approximately the centroid of the luggage compartment 30. The force of gravity acting on the luggage compartment and its contents when loaded produces a downward force component through the center of gravity 100 as indicated by the arrow 101. When the backpack P is supported by a person's shoulder, the shoulder exerts a vertical force 102 directed upwardly. The combination of forces 101 and 102 produces a couple tending to rotate the backpack in a clockwise direction resulting in a force indicated by arrow 103 directed horizontally or transversely into the lower portion of a person's back. In order to resist this force, the person must constantly strain the lower portion of his back against the transverse force 103 which results in fatigue and ache after an extended period of time. Therefore, when he exerts a vertically downwardly directed force indicated by the arrow 104 with his arms on the levers 10, 12 the effective composite downwardly directed force resulting from the combination of gravity acting on the backpack and the force exerted by the arm on the distal end of the lever is centered more nearly over the shoulder in approximate alignment with the upwardly directed force 102 exerted by the shoulder on the backpack. Consequently, the couple and the resulting transverse force 103 on the person's lower back are substantially eliminated.

The extent to which the person desires the transverse force 103 to be reduced or eliminated for whatever comfort he happens to require at a particular time can be regulated by the amounts of downward force 104 he exerts on the distal end of the levers 10, 12 with his arms. The pivotal attachment of the levers 10, 12 to the rigid frame 20, as described above, allows the rigid frame 20 to remain in uniform contact with the length of the wearer's back regardless of where the person sets the levers 10, 12 at any particular time.

Figure 7:
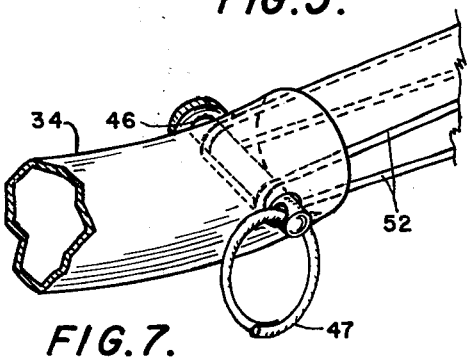
FIG. 7 is a view of the distal end of the lever illustrating the attachment of the flexible strap to the lever.

Adjustable, flexible straps 50, 52 are provided to retain the distal ends 32, 34 of the levers 10, 12, respectively, at any desired distance from the lower end of the upright members 22, 24 when the person desires to rest his arms or to use his arms for other purposes. As best seen in FIGS. 1, 2 and 7, the strap 52 is connected to the lower end of rigid frame member 24 by clevis 56 and it is connected to the distal end 34 of lever 12 by passing around pin 46. Pin 46 is retained in proper position in the distal end 34 of lever 12 by lock ring 47. A buckle 53 is provided for adjustably setting the length of the strap to any desired position. As best seen in FIG. 1, strap 50 is similarly attached to the lower end of frame member 22 by clevis 54 and to the distal end 32 of lever 10 by passing over pin 44 which is positioned in the end of lever 10. Pin 44 is also retained in position by a lock ring 45.

As described above, a shoulder pad 14 is attached to the underside of lever 10 near its upper end 40 in the vicinity of the upper bend 36. A similar shoulder pad 16 is attached to the underside of lever 12 near its upper end 42 in the vicinity of its bend 38. When the backpack levers are worn in proper position, the pads 14, 16 are positioned on the wearer's shoulders as shown in FIGS. 2 and 3. Since the clamp 58, 60 can be adjusted circumferentially around the upright members 22, 24, respectively, by loosening the set screws, adjusting to the desired orientation, and then tightening the set screws, the shoulder pads 14, 16 can be adjusted closer together or farther apart depending on the position most comfortable to a particular wearer.

Figure 8:
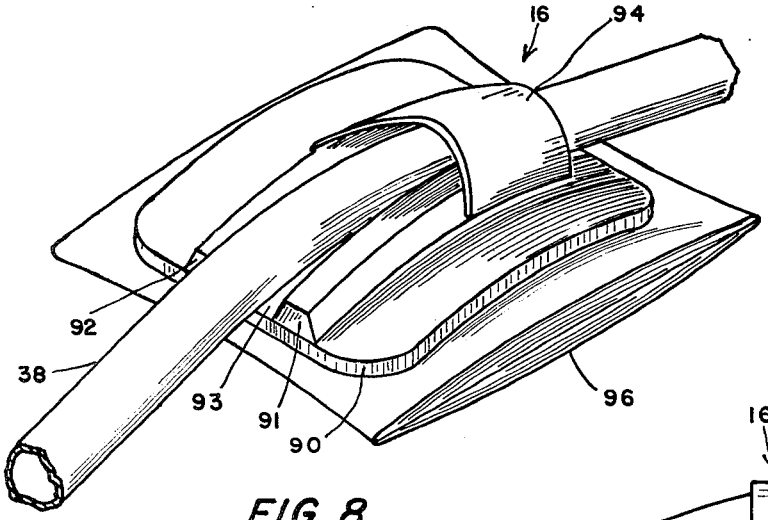
FIG. 8 is an enlarged perspective view of the shoulder pads attached to the lever.
Figure 9:
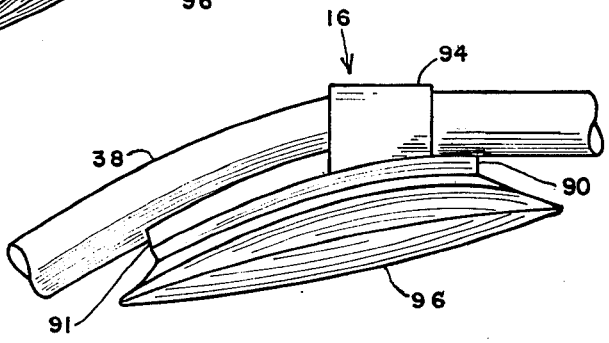
FIG. 9 is an enlarged side elevational view of the shoulder pads attached to the lever.

As best seen in FIGS. 8 and 9, the shoulder pad 16, which is also typical of shoulder pad 14, is constructed with a rigid base plate 90 having an arcuate cross-section so that its top surface is curved substantially corresponding to the curved portion 38 of lever 12. Ribs 91, 92 extend longitudinally along the upper surface of base plate 90 in parallel, spaced-apart relation to each other forming a channel 93 between them. When the shoulder pad 16 is properly secured on to the underside of lever 12, the curved portion 38 is received in the channel 93 between ribs 91, 92, and the shoulder pad 16 is retained in that position by a resilient strap 94 which is attached at its ends to the base plate 90 and with its midsection passing over the lever 12. A padded cushion 96 is affixed to the bottom side of the base plate 90 to provide more comfort to the wearer by cushioning the effect of the load over the contours of his shoulder.

When the shoulder pad 16 is positioned slightly above the bend 38, the upper surface of the base plate 90 can pivot or rock in relation to the underside of lever 12 to allow the shoulder pad to orient itself to conform to the surface of the wearer's shoulders. Since the retaining strap 94 is resilient, it accommodates such pivoting or rocking to a limited extent while retaining the shoulder pad 16 in proper position on the lever 12. The resiliency of the strap 94 also allows the shoulder pad 16 to be adjustably moved forward or backward along the lever 12 to any desired position to provide the most comfort.

Placement of the resilient strap 94 toward the rear of base plate 90, as shown in FIGS. 8 and 9, the normal position of the rigid plate 90 is with its rear portion in contact with the underside of lever 12 while the forward portion is spaced apart a small distance under the lever 12. However, if the shoulder provides more force toward the forward end of the shoulder pad 16, the resilient strap 94 will yield to allow the rigid base plate 90 to rotate a limited amount until the space between the forward end of the base plate and the underside of the lever 12 is eliminated. It has been found that this rearward position of the resilient strap 94 is most beneficial when the shoulder pad 16 is positioned slightly forward of the center of the person's shoulder, as shown in FIG. 2. However, its resilience will still allow the shoulder pad to conform to the contour of the person's shoulder regardless of where it is positioned. Alternatively, the resilient strap 94 could be positioned midway between the front and rear portions of the base plate 90 which may be more desirable if the person prefers to wear the shoulder pad directly on top of his shoulder.

An added benefit or advantage of the backpack levers of the present invention is illustrated in FIG. 1, wherein the straps 50, 52 are adjusted so that they retain the levers 10, 12, respectively, in a position where they can hold the backpack P in substantially upright position when it is not being worn. Consequently, a person can set his backpack on the ground in an upright position for convenience of finding items in the luggage compartment 30 or packing the luggage compartment before leaving a camp site without having to find a tree or other object against which to lean his backpack P.

Because there are no straps or belts around the person's body, the backpack is not only easy to put on for wearing, but it also can be slipped off easily and quickly. This feature is a distinct safety advantage for a person who may inadvertently slip and fall in a fast-moving stream of water or on a ledge where the weight of the backpack or its tendency to restrict movement can become a hazard by preventing the person from freeing himself or extricating himself from a dangerous position. When wearing the backpack of the present invention, if he becomes involved in such a dangerous situation, the backpack can be quickly removed by simply slipping it off his shoulders without the necessity of loosening any straps or buckles from around his body.

Although the present invention has been described with a certain degree of particularity, it is understood that the present disclosure has been made by way of example and that changes in details of structure may be made without departing from the spirit thereof.

What is claimed is:

1. In a backpack for transporting cargo on a person's back having a frame adapted to be releasably secured to the back and shoulders of a person and having a load-carrying component attached to said frame, the improvement comprising a pair of rigid levers, each of which is pivotally attached to said frame for pivotal movement about a horizontal axis and being spaced apart a sufficient distance to be positioned on opposite of a person's shoulders with the person's head positioned between said levers, each of said levers extending forwardly of said frame to a first point above a respective one of said shoulders and then outwardly and downwardly from said shoulder in spaced relation to said person to a distal end located at a second point forward of said shoulders, the distance between said first and second points being greater than the distance between said first point and said frame, said shoulders forming a fulcrum about which said levers may be pivoted when a downward force is applied on said lever near said second point to apply an upward force on said frame at the point of pivotal connection of said lever to said frame and diminish horizontal forces acting on said shoulders.

2. The backpack of claim 1, including shoulder support means on the underside of each of said levers adapted to distribute the effective load of said levers and frame on the person's shoulders, each of said shoulder support means includes a relatively rigid base plate having a convex upper surface in rocking contact with the underside of said lever, a relatively soft cushion affixed to the bottom surface of said base plate, and securing means on the top surface of said base plate for securing said base plate to said lever in a manner that allows said base plate to move in a rocking motion in relation to said lever.

3. The backpack of claim 2, wherein said base plate is curved in an arcuate cross-section and includes two parallel, spaced-apart ribs on its top surface forming a channel therebetween, said lever is positioned in said channel, and said securing means includes a resilient strap, the ends of which are connected to the top surface of said base plate on respectively opposite sides of said channel and which passes over said lever to yieldingly retain said base plate in secured, contacting relation to said lever.

4. The backpack of claim 1, including a flexible, adjustable strap extending between the distal end of each of said levers and the lower end of said frame.

5. The backpack of claim 1, including pivotal attachment means on one end of each of said levers a spaced distance rearwardly of the portion of said lever that rests on the person's shoulders for pivotally attaching said lever to a vertical portion of a tubular frame member of the backpack frame, said pivotal attachment means including a clamp for tightly gripping said frame member and a pivot pin extending transversely through said one end of said lever and threadedly received in said clamp, said clamp also being rotatably adjustable on said frame member for adjusting the forward projecting orientation of said lever.

6. Backpack lever apparatus for supporting a backpack comprising:

two levers in spaced-apart relation to each other pivotally connected to a backpack in a manner that accommodates pivotal movement between said levers and said backpack about a horizontal axis, which backpack has two spaced-apart vertical frame members, each of said levers having a horizontal portion at its upper end extending forwardly into a curved portion from which a forward portion extends at an angle generally forwardly and downwardly terminating at a distal end such that when worn with a backpack by a person said horizontal section extends from one of the vertical frame members forwardly over the person's shoulder, said curved portion curves downwardly over the front of the person's shoulders, and said forward portion extends in front of the person's chest and torso to said distal end which is positioned a spaced distance in front of and generally level with the person's waist where it can be conveniently grasped with the hands;

pivotal connector means at said upper end of each of said levers for pivotally connecting said levers adjacent to opposite of said frame members; and shoulder support means secured under each of said levers in the vicinity of where said horizontal member extends forwardly into said curved portion for distributing the load over a larger area on the person's shoulder.

7. The backpack lever apparatus of claim 6, wherein said levers are tubular members and said shoulder support means includes a relatively rigid base plate having an arcuate cross-section and a curved top portion for rocking contact with the underside of said lever, a padded cushion on the bottom surface of said base plate, and a resilient strap attached at both ends to said top surface and passing over said lever for yieldingly retaining said base plate in rocking contact with said lever.

8. The backpack lever apparatus of claim 6, including a flexible, adjustable strap adapted to extend between said distal end of each lever and the backpack frame in substantially perpendicular relation to said backpack frame when said backpack is worn and said straps are adjustably tightened.

9. The backpack lever apparatus of claim 6, wherein said pivotal connection means includes an adjustable clamp for tightly gripping the vertical frame member of the backpack and a pivot pin extending transversely through the upper end of said lever and threadedly received in said clamp.

10. The backpack lever apparatus of claim 6 wherein the lower distal end of each lever has a rearwardly curved return portion of sufficient radius of curvature to facilitate grasping with the hands.

* * * * *